US005527258A

United States Patent [19]

Leung et al.

[11] Patent Number: 5,527,258

[45] Date of Patent: *Jun. 18, 1996

[54] FEED ACCELERATOR SYSTEM INCLUDING ACCELERATING CONE

[75] Inventors: Woon F. Leung, Norfolk; Ascher H. Shapiro, Jamaica Plain, both of Mass.

[73] Assignee: Baker Hughes Incorporated, Houston, Tex.

[ * ] Notice: The term of this patent shall not extend beyond the expiration date of Pat. No. 5,380,266.

[21] Appl. No.: 307,940

[22] Filed: Sep. 16, 1994

Related U.S. Application Data

[62] Division of Ser. No. 798,898, Nov. 27, 1991, Pat. No. 5,380,266.

[51] Int. Cl.[6] ..... B04B 1/20; B04B 3/04

[52] U.S. Cl. ..... 494/53; 494/67; 494/85

[58] Field of Search ..... 421/53, 54, 52, 421/67, 85; 210/377

[56] References Cited

U.S. PATENT DOCUMENTS

| | | | |
|---|---|---|---|
| 579,301 | 3/1897 | Lundstrom . | |
| 978,238 | 12/1910 | Trent | 494/67 |
| 2,138,467 | 11/1938 | Ayres et al. . | |
| 2,138,468 | 11/1938 | Ayres . | |
| 2,243,697 | 5/1941 | Forsberg . | |
| 2,259,665 | 10/1941 | Serrell, Jr. . | |
| 2,435,623 | 2/1948 | Forsberg . | |
| 2,593,294 | 4/1952 | Goldberg . | |
| 2,648,496 | 8/1953 | Cresswell | 494/67 |
| 2,727,629 | 12/1955 | Hertrich . | |
| 2,733,856 | 2/1956 | Kjellgren . | |
| 2,862,659 | 12/1958 | Nyrop . | |
| 2,893,562 | 7/1959 | McPhee et al. . | |
| 3,075,695 | 1/1963 | Ayres | 494/67 |
| 3,136,722 | 6/1964 | Gooch . | |

FOREIGN PATENT DOCUMENTS

| | | |
|---|---|---|
| 758458 | 5/1967 | Canada . |
| 766609 | 9/1967 | Canada . |
| 784032 | 4/1968 | Canada . |
| 787763 | 6/1968 | Canada . |
| 860107 | 1/1971 | Canada . |
| 953267 | 8/1974 | Canada . |
| 972732 | 8/1975 | Canada . |
| 1096829 | 3/1981 | Canada . |
| 1132954 | 10/1982 | Canada . |
| 260172 | 9/1988 | German Dem. Rep. . |
| 1065333 | 9/1959 | Germany . |
| 2407833 | 8/1975 | Germany . |
| 3723864 | 1/1989 | Germany . |
| 1194505 | 11/1985 | U.S.S.R. . |
| 1327910 | 8/1987 | U.S.S.R. . |
| 1194563 | 6/1970 | United Kingdom . |

(List continued on next page.)

*Primary Examiner*—David Scherbel
*Assistant Examiner*—Reginald L. Alexander
*Attorney, Agent, or Firm*—Cesari and McKenna

[57] ABSTRACT

A feed accelerator system for use in a centrifuge, the system comprising a conveyor hub rotatably mounted substantially concentrically within a rotating bowl, and an accelerator including a cone-shaped inside surface disposed between an accelerator base and an accelerator small diameter section. The accelerator is secured proximately to its base within the conveyor hub so that the accelerator rotates with the conveyor hub. A distributor including a distributor surface having no sharp bends or junctions is secured to the small diameter section. A plurality of accelerator vanes are disposed on the cone-shaped inside surface and extend proximately from the small diameter section and terminate at a location on the cone-shaped inside surface proximate to the accelerator base so that an unvaned portion of the cone-shaped inside surface forms a smoothener section. A feed pipe having at least one discharge opening is disposed within the centrifuge so that the discharge opening is positioned proximately to the distributor surface at a stand-off distance. The stand-off distance, feed slurry flow rate, diameter of the feed pipe, location of the accelerator vanes proximate to the small diameter section, and number of vanes are selected to obtain overall maximum centrifuge efficiency.

1 Claim, 11 Drawing Sheets

U.S. PATENT DOCUMENTS 3,143,504 8/1964 Schneider .
3,170,874 2/1965 Iono .
3,268,078 8/1966 Muggli .
3,268,083 8/1966 Ruegg .
3,289,843 12/1966 Nyrop .
3,301,708 1/1967 von Rotel .
3,361,264 1/1968 Quetsch .
3,365,066 1/1968 Howell .
3,424,375 1/1969 Maurer .
3,428,246 2/1969 Finkelston .
3,482,771 12/1969 Thylefors .
3,483,991 12/1969 Humphrey .
3,616,992 11/1971 Deacon .
3,620,442 11/1971 Halloran, Jr. .
3,734,398 5/1973 Keith, Jr. et al. .
3,779,450 12/1973 Shapiro .
3,794,177 2/1974 Lega et al. .
3,795,361 3/1974 Lee .
3,799,431 3/1974 Lavanchy et al. .
3,831,764 8/1974 Humphrey .
3,885,734 5/1975 Lee .
3,963,175 6/1976 Daubman et al. .
3,967,778 7/1976 Hunwick .
4,173,303 11/1979 Cyphelly .
4,245,777 1/1981 Lavanchy .
4,283,286 8/1981 Wilkesmann .
4,295,600 10/1981 Saget .
4,299,353 11/1981 Bruning et al. .
4,320,007 3/1982 Hultsch et al. .
4,334,647 6/1992 Taylor ..... 494/53
4,427,407 1/1984 Paschedag .
4,449,967 5/1984 Caldwell .
4,731,182 3/1988 High .
4,753,633 6/1988 Callegari, Sr. et al. .
4,889,627 12/1989 Hoppe .
4,978,370 12/1990 Klintenstedt .
5,031,522 7/1991 Brixel et al. .
5,380,266 1/1995 Leung et al. ..... 494/53

FEED ACCELERATOR SYSTEM INCLUDING ACCELERATING CONE

This is a divisional of copending application(s) Ser. No. 07/798,898 filed on Nov. 27, 1991, U.S. Pat. No. 5,380,266.

BACKGROUND OF THE INVENTION

Conventional sedimentation or filtration systems operating under natural gravity have a limited capacity for separating a fluid/particle or fluid/fluid mixture, otherwise known as a feed slurry, having density differences between the distinct phases of the slurry. Therefore, industrial centrifuges that produce large centrifugal acceleration forces, otherwise known as G-levels, have advantages and thus are commonly used to accomplish separation of the light and heavy phases. Various designs of industrial centrifuges include, for example, the decanter, screen-bowl, basket, and disc centrifuge.

Industrial centrifuges rotate at very high speeds in order to produce large centrifugal acceleration forces. Several problems arise when the feed slurry is introduced into the separation pool of the centrifuge with a linear circumferential speed less than that of the centrifuge bowl.

First, the centrifugal acceleration for separation is not fully realized. The G-level might be only a fraction of what is possible. The G-level is proportional to the square of the effective acceleration efficiency. The latter is defined as the ratio of the actual linear circumferential speed of the feed slurry entering the separation pool to the linear circumferential speed of the rotating surface of the separation pool. For example, if the acceleration efficiency is 50 percent, the G-level is only 25 percent of what might be attained and the rate of separation is correspondingly reduced.

Second, the difference in circumferential linear speed between the slurry entering the separation pool and the slurry within the separation pool which has been fully accelerated by the rotating conveyor and bowl leads to undesirable slippage, otherwise known as velocity difference, and this creates turbulence in the slurry lying within the separation pool. Such turbulence results in resuspension of the heavy phase, equivalent to a remixing of the heavy phase material and the lighter phase material.

Third, because a portion of the separation pool is used to accelerate the feed slurry, the useful volume of the separation pool is reduced, and thus the separation efficiency of the centrifuge is lessened.

Fourth, the feed slurry often exits the feed accelerator of the centrifuge in a non-uniform flow pattern, such as in concentrated streams or jets. In a decanter centrifuge, such a non-uniform flow entering the separation pool causes remixing of the light and heavy phases, and thus reduces the separation efficiency of the centrifuge. In basket-type centrifuges, a non-uniform flow incident upon the basket causes ridges and valleys which act detrimentally upon the deliquoring of the resultant product as well as upon any required washing of the resultant product.

In view of these problems, it is desirable to incorporate feed acceleration enhancements into feed accelerators so that the feed acceleration and separation efficiency of the centrifuge are increased.

SUMMARY OF THE INVENTION

The feed accelerator system of the invention comprises a conveyor hub rotatably mounted substantially concentrically within a rotating bowl, and a feed accelerator including a generally cone-shaped inside surface having an included angle of less than one hundred and eighty degrees. The inside surface is disposed between an accelerator base and an accelerator small diameter section and the accelerator is secured to the conveyor hub so that the accelerator rotates with the conveyor hub. A distributor is secured to the small diameter section by a distributor mounting apparatus and includes a non-convex distributor surface having no sharp bends or junctions.

A plurality of accelerator vanes is disposed on the cone-shaped inside surface so as to form a plurality of feed channels, the accelerator vanes generally extending proximately from the small diameter section and terminating at a location on the cone-shaped inside surface prior to the base so that an unvaned portion of the cone-shaped inside surface forms a smoothener section on the cone-shaped inside surface. A generally cylindrical feed pipe is disposed within the centrifuge for delivering a feed slurry having a determinable flow rate to the accelerator. The feed pipe includes at least one discharge opening located proximately to a feed pipe end so that the discharge opening is positioned proximately to and faces the distributor surface at a stand-off distance.

The stand-off distance, feed slurry flow rate, diameter of the discharge opening, location of the accelerator vanes proximate to the small diameter section, and number of acceleration vanes are mutually coordinate and generally within predetermined and appropriate ranges so that such variables may be selected to achieve minimum splash back of the feed slurry engaging the distributor surface, uniform distribution of the feed slurry into the feed channels, circumferential flow uniformity, maximum acceleration of the feed slurry, and maximum separation efficiency.

Various acceleration vane configurations may be used to increase the acceleration efficiency of the centrifuge. Such configurations include radial extending vanes, forwardly angled vanes, and forwardly curved vanes. Wear resistant inserts may also be provided within the feed channels formed by the vanes so as to decrease the cost of repeated maintenance to the centrifuge.

DESCRIPTION OF THE PREFERRED EMBODIMENT

Figure 1A:
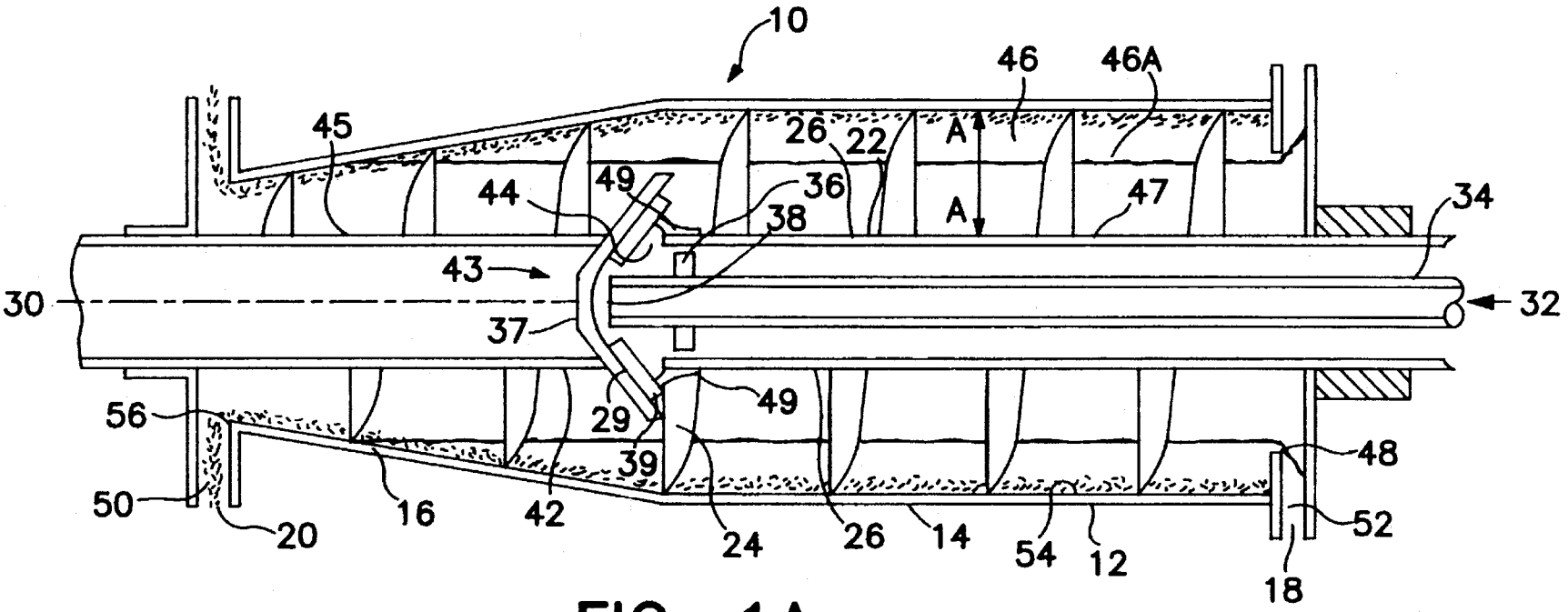
FIG. 1A is a schematic cross-sectional view of a decanter centrifuge including a cone-shaped accelerator of the invention.
Figure 1B:
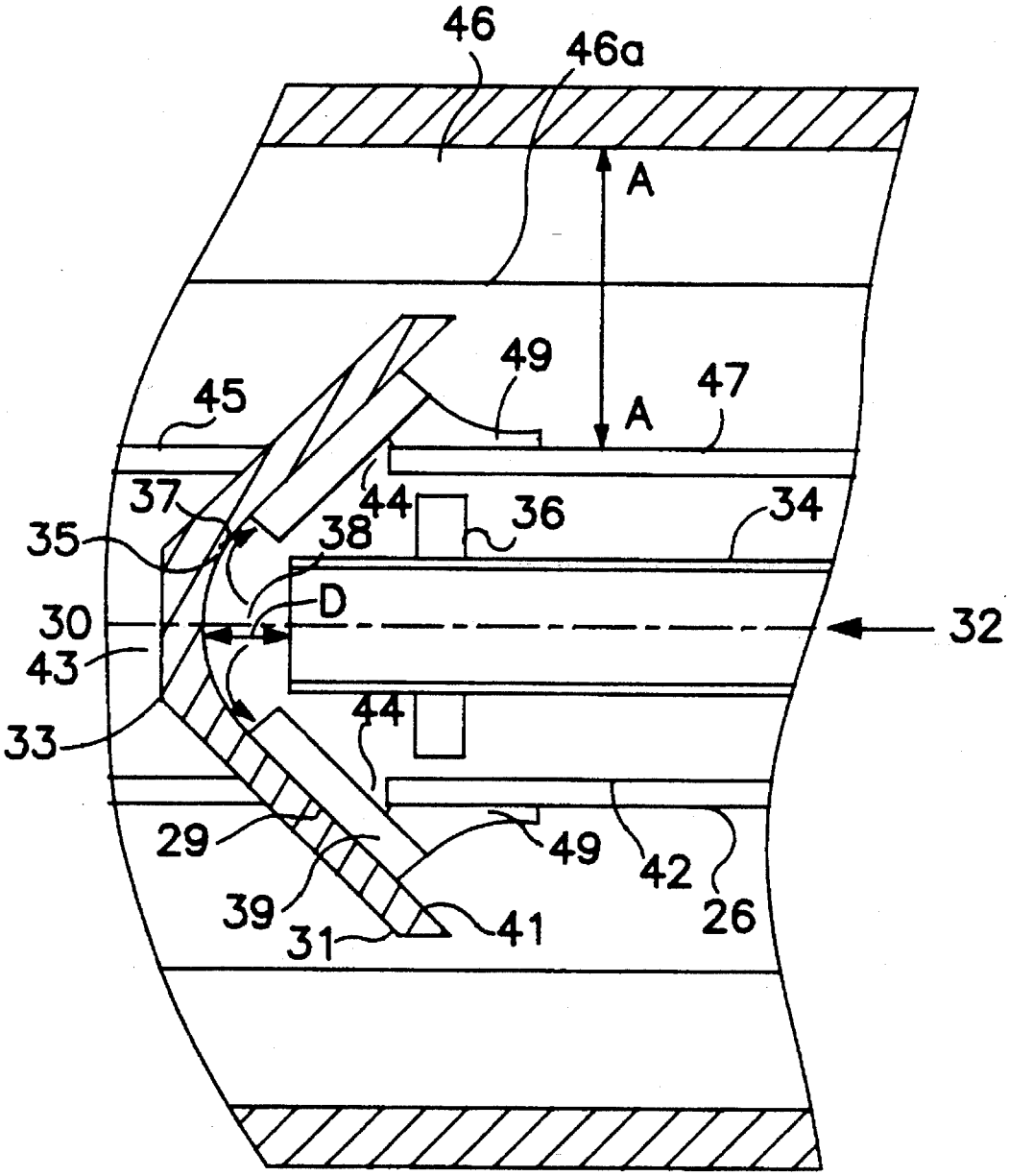
FIG. 1B is an enlarged cross-sectional view of the cone-shaped hub accelerator of FIG. 1A.

FIG. 1A shows a decanter centrifuge 10 of the invention for separating heavier-phase substances, such as solids, from lighter-phase substances, such as liquids. The centrifuge 10 includes a bowl 12 having a generally cylindrical clarifier section 14 adjacent to a tapered beach section 16, at least one lighter-phase discharge port 18 communicating with the clarifying section 14, and at least one heavier-phase discharge port 20 communicating with the tapered beach section 16. A screw-type conveyor 22 is rotatably mounted substantially concentrically within the bowl 12, and includes a helical blade 24 disposed about a conveyor hub 26 having a first hub section 45 and a second hub section 47, and a feed distributor and accelerator secured thereto. As shown in FIGS. 1A and 1B, the preferred embodiment of the invention includes a cone accelerator 43 having a distributor surface 37, a generally cone-shaped inside surface 29, and accelerator vanes 39 attached thereto and extending outwardly from the distributor surface 37. The bowl 12 and conveyor 22 rotate at high speeds via a driving mechanism (not shown) but at different angular velocities about an axis of rotation 30.

A feed slurry 32 having, for example, solids 50 suspended in liquid 52, is introduced into the centrifuge 10 through a generally cylindrical feed pipe 34 disposed within the conveyor hub 26 by a mounting apparatus (not shown) at a predetermined and appropriate stand-off distance D from a non-convex distributor surface 37 of the cone accelerator 43. As shown in FIG. 1A, a feed pipe baffle 36 is secured to the feed pipe 34 to prevent the feed slurry 32 from flowing back along the outside surface of the feed pipe 34 and the inside surface 42 of the conveyor hub 26. Alternatively, the baffle 36 may be attached to the inside surface 42 of the conveyor hub 26. The feed slurry 32, having a determinable flow rate, exits the feed pipe 34 through a discharge opening 38 proximate to the end of the feed pipe 34, and engages the distributor surface 37 and the vanes 39.

The feed slurry 32 exits the conveyor hub 26 through a passageway 44 formed by the first and second hub sections 45 and 47 of the conveyor hub 26, and enters the zone A—A formed between the conveyor hub 26 and the bowl 12. The feed slurry 32 then forms a separation pool 46 having a pool surface 46A within the zone A—A, adjacent to the inside surface of the bowl 12. As shown in FIG. 1A, the depth of the separation pool 46 is determined by the radial location of one or more dams 48 positioned between the liquid discharge port 18 and the separation pool 46.

The centrifugal force acting within the separation pool 46 causes the suspended solids 50 in the separation pool 46 to sediment on the inner surface 54 of the bowl 12. The sedimented solids 50 are conveyed "up" the tapered beach section 16 by the differential speed relative to the bowl 12 of the helical blade 24 of the conveyor 22, pass over a spillover lip 56 proximate to the solids discharge port 20, and exit the centrifuge 10 via the solids discharge port 20. The liquid 52 leaves the centrifuge 10 through the liquid discharge port 18 after flowing over the dam(s) 48. Persons skilled in the certrifuge art will appreciate that the separation of heavier-phase substances from lighter phase-substances can be accomplished by other similar devices.

Conventional feed distributors and accelerators do not accelerate the feed slurry 32 to the linear circumferential speed of the separation pool surface 46A, with the consequences of reduced acceleration efficiency and separation efficiency of the centrifuge. Therefore, it is desirable to equip the feed accelerator with feed slurry acceleration and circumferential flow uniformity enhancements that result in maximum acceleration and separation efficiency. Of particular importance is to select a stand-off distance D of the discharge opening 38 from the distributor surface 37 so as to maintain, within preselected and appropriate limits, and in coordination with the feed pipe 34 diameter and the feed slurry flow rate, the gravitational droop of the feed slurry 32 exiting the discharge opening 38. Also important is to shape the distributor surface 37 in relationship to the cone-shaped inside surface 29 and vanes 39 so as to avoid splashback of the feed slurry 32 with resultant loss of contact of the feed slurry 32 with the cone accelerator 43 and consequent loss of accelerator efficiency. It is also important to coordinate the combination of the stand-off distance D, feed slurry 32 flow rate, diameter of the discharge opening 38, starting location of the accelerator vanes 39 proximate to the distributor surface 37, and number of accelerator vanes so as to achieve minimum splashback of the feed slurry 32 engaging the distributor surface 37, uniform distribution of feed slurry into the feed channels 58, circumferential flow uniformity, maximum acceleration efficiency of the feed slurry 32, and maximum separation efficiency of the centrifuge 10.

The preferred embodiment of the feed accelerator of the invention is shown in FIG. 1B with the helical blade 24 removed for clarity. A ring-shaped passageway 44 is formed between the first and second conveyor hub sections 45 and 47. A cone-shaped accelerator 43 including a cone-shaped inside surface 29 having an included angle of less than one hundred and eighty degrees is disposed between the first and second hub sections 45 and 47. The inside surface 29 is disposed between an accelerator base 31 and an accelerator small diameter section 33.

Figure 4A:
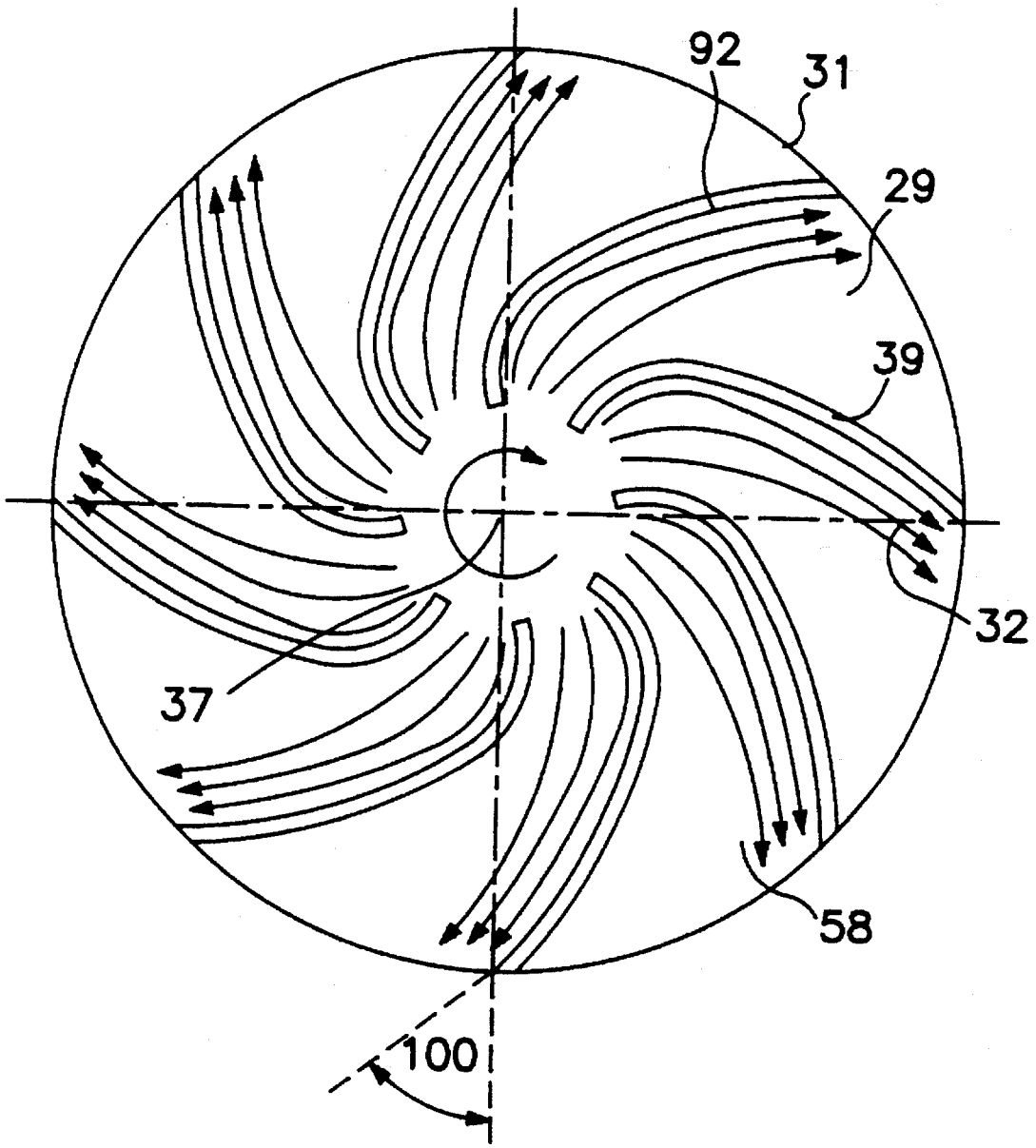
FIG. 4A is an axial view of a cone-shaped accelerator having forwardly curved vanes.

Attached to the small diameter section 33 is a distributor 35 having a distributor surface 37. A plurality of accelerator vanes 39 are disposed on the inside surface 29. The number of acceleration vanes 39 is selected according to the flow rate and viscosity of the feed slurry 32. Although accelerator vanes 39 increase acceleration efficiency, they cause the feed slurry 32 to exit the cone-shaped accelerator 43 in concentrated streams or jets. FIG. 4A shows that as the feed slurry 32 flows outwardly from the distributor surface 37, the slurry 32 builds up along the leading face 92 of each accelerator vane 39 and flows in a generally outward direction while following the contour of leading face 92. Most of the flow of feed slurry 32 accumulates in a concentrated stream flowing along leading face 92.

Figure 4B:
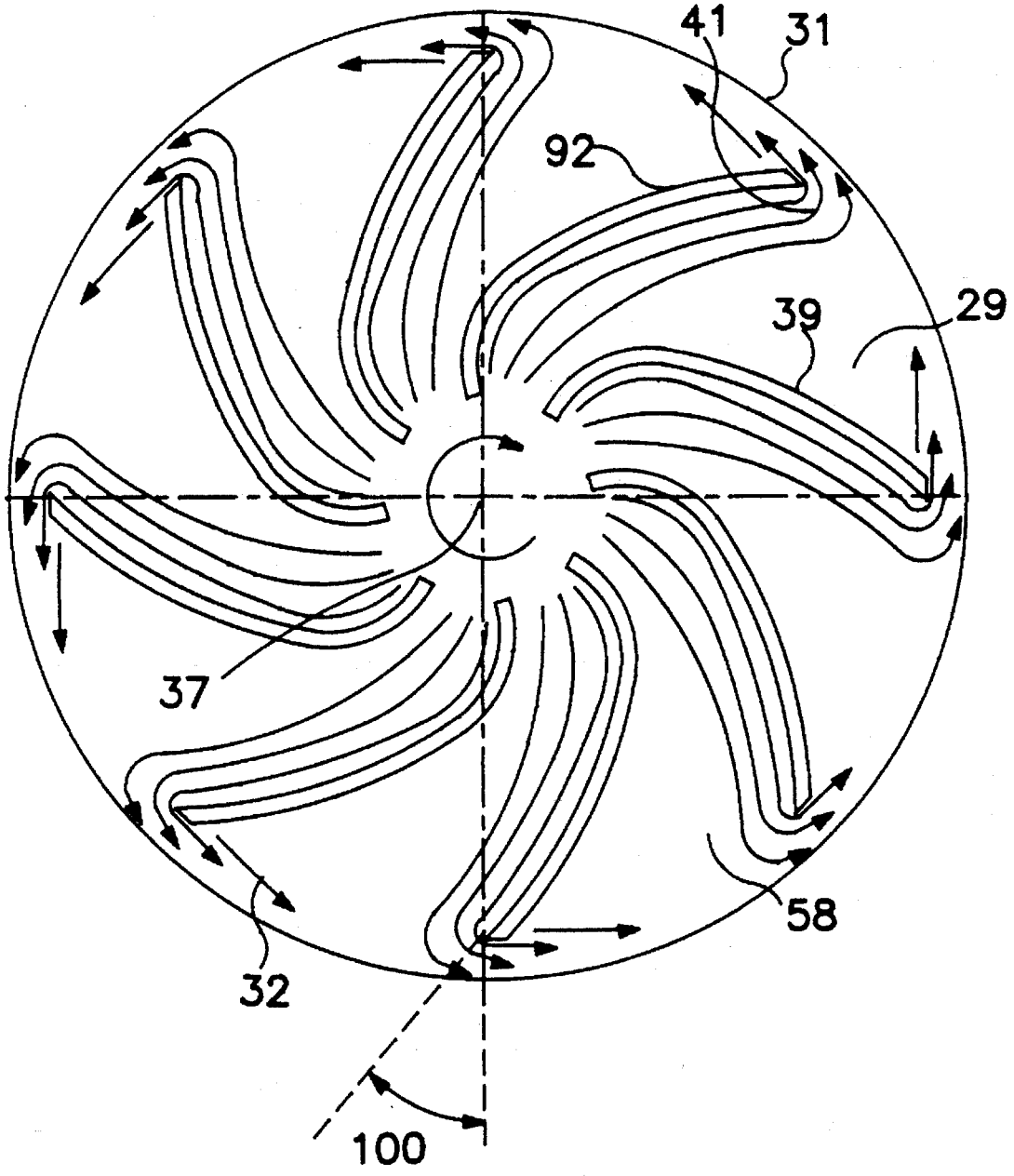
FIG. 4B is an axial view of a cone-shaped accelerator including forwardly curved vanes and a smoothener section.

If the accelerator vanes 39 extend to the base 31 of the cone accelerator 43, the feed slurry 32 exits the accelerator in concentrated streams or jets. When such streams or jets enter the separation pool 46, they have the effect of remixing the feed slurry 32 already separated in the pool 46, thus resulting in reduced separation efficiency. To avoid this remixing, acceleration vanes 39 terminate before the base 31 of the cone accelerator 43, thus forming an unvaned smoothener section 41. As shown in FIG. 4B, when the feed slurry 32 reaches the smoothener section 41, the differential speed between the feed slurry stream and the cone inside surface of the smoothener section 41 causes the streams or jets of feed slurry 32 to smear out circumferentially, thus depositing a smoother or more circumferentially uniform flow into the separation pool 46, thereby reducing remixing and increasing separation efficiency. In certain applications, the accelerator base 31 may be below the pool surface 46A of the separation pool 46 in which case the acceleration vanes 39 should terminate before reaching the pool surface 46A so that the unvaned portion of the cone-shaped inside surface 29 above the pool surface 46A would act as a smoothener 41.

In FIG. 1B the cone-shaped accelerator 43 is secured to the first hub section 45 and secured to the second hub section 47 by attachment rib structures 49 extending from the second hub section 47 to the cone-shaped inside surface 29. Alternatively, the attachment rib structures 49 may be secured to or made integral with several of the accelerator vanes 39. As shown, the base 31 of the cone-shaped accelerator 43 extends into and beyond the passageway 44 proximate to the the separation pool surface 46A. It is understood, however, that the base 31 may extend only to the passageway 44, or beyond the passageway 44, or into the separation pool 46.

Figure 2:
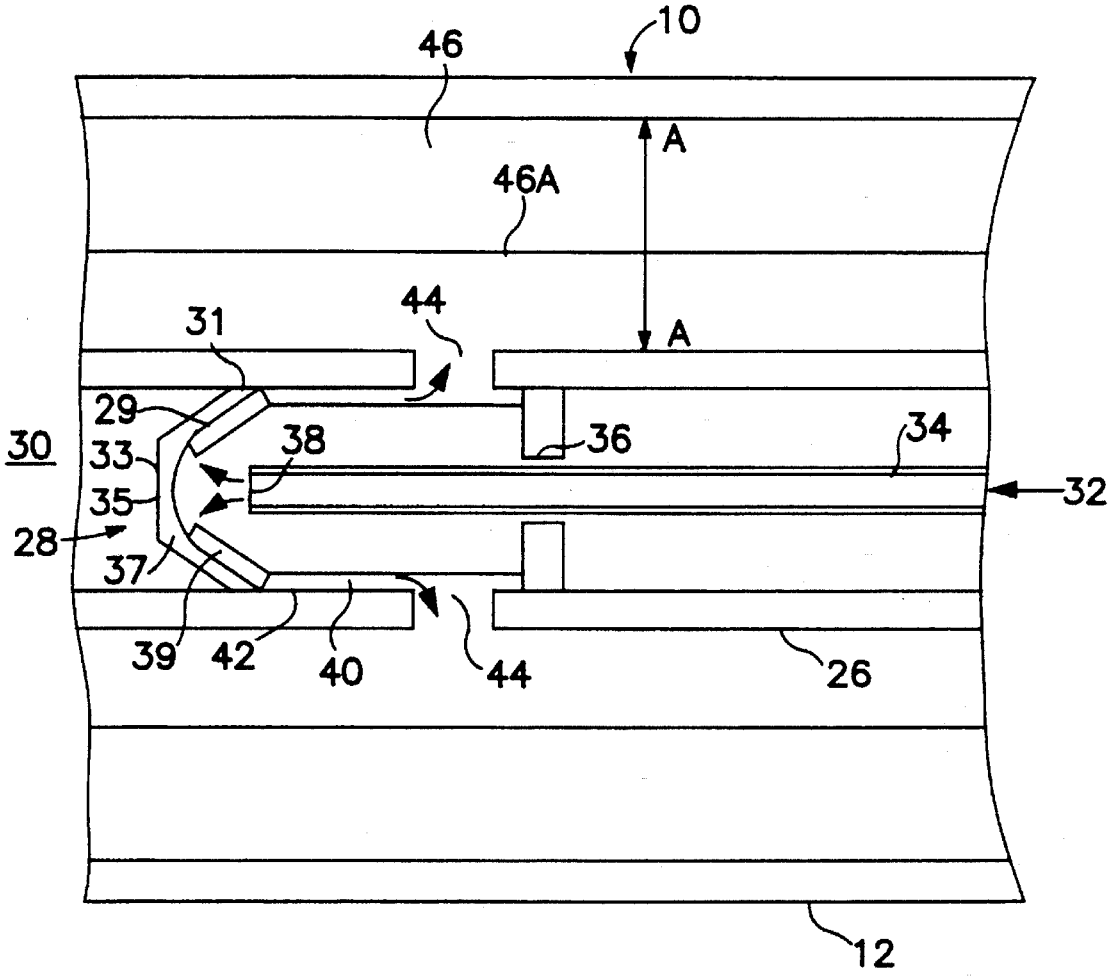
FIG. 2 is a cross-sectional view of a hub accelerator of the invention.

FIG. 2 shows an embodiment of a hub accelerator 28 of the invention with the helical blade 24 removed for clarity. The hub accelerator 28 includes a cone-shaped inside surface 29 having an included angle of less than one hundred and eighty degrees. The inside surface 29 is disposed between an accelerator base 31 and an accelerator small diameter section 33. A feed distributor 35 having a distributor surface 37 is removably secured to the small diameter section 33 by a mounting apparatus, as more fully described below. A plurality of accelerator vanes 39 are disposed on the inside surface 29 and extend from the small diameter section 33 to the base 31.

After engaging the distributor surface 37, the feed slurry 32 flows into the feed channels formed by the accelerator vanes 39. After acceleration by the vanes 39, the feed slurry 32 exits the feed channels and forms a slurry pool 40 in the inside surface 42 of the conveyor hub 26. The feed slurry 32 then travels along the inside surface 42 of the conveyor hub 26 before exiting the conveyor hub 26 through a plurality of passageways 44 formed in the wall of the conveyor hub 26.

The use of accelerator vanes 39 on the inside surface 29 of the hub accelerator 28, or other cone-shaped accelerators, is effective as a feed accelerator enhancement because such vanes 39 apply a force to the feed slurry 32 in the direction of rotation of the conveyor hub 26. More specifically, as shown in FIG. 4A, the leading face 92 of each vane 39 applies a circumferential pressure force to the feed slurry 32 so as to increase the tangential velocity of the feed slurry 32 flowing from the distributor to the zone A—A. Without such vanes 39, the feed slurry 32 achieves its tangential velocity only through the action of relatively weak viscous forces acting at the inside surface 29 of the accelerator 28.

The cone-shaped accelerator 43 of the invention may also be used in several types of basket centrifuges well known in the industry. For example, the two-stage pusher-type centrifuge 60 of FIG. 3 includes a rotating and reciprocating first-stage basket 62 (mechanism not shown) having perforations 63 for removing separated liquid 52, the basket 62 rotatably mounted to shaft 64 actuated by a power supply (not shown). The first-stage basket 62 is disposed within a second-stage basket 66 having perforations 65 for removing additional separated liquid 52, such basket 66 rotatably mounted to shaft 68 actuated by the power supply. A stationary solids discharge chute 74 is spaced from the outer edge of the second-stage basket 66. Both the first- and second-stage baskets 64 and 66 are housed within a stationary and generally cylindrical housing 72 in which separated liquids 52 collect.

A cone-shaped accelerator 43 having a plurality of accelerator vanes 39 attached to the cone-shaped inside surface 29 is secured within the centrifuge 60 so that the accelerator base 31 extends proximately to the inner surface of the first-stage basket 62. A distributor 35 having a smoothly curved distributor surface 37 is attached to the rotating but non-reciprocating circular pusher plate 61, which in turn, is attached to the second-stage basket 66 by struts 70. The rotating cone accelerator 43 is secured to the distributor 35 by a set of struts 37A or similar fasteners.

A feed pipe 34 having a discharge opening 38 proximate to and facing the distributor surface 37 at a stand-off distance D delivers a feed slurry 32 into the pusher centrifuge 60. After engaging the distributor surface 37, as shown by the arrows in FIG. 3, the feed slurry 32 flows into the feed channels 58 formed by the accelerator vanes 39, as shown in FIG. 4B. The accelerator vanes 39 accelerate the feed slurry 32 to a rotational speed up to or greater than the rotational speed of the first-stage basket 62.

When the feed slurry 32 enters the smoothener section 41, the concentrated streams or jets of feed slurry 32 caused by the accelerator vanes 39 are smeared out into a smooth and circumferentially uniform flow pattern. The feed slurry 32 is then deposited onto the inside surface of the first-stage basket 62 where the centrifugal force associated with rotation acts to separate the liquid 52 from the solids 50 of the feed slurry 32. A portion of the liquid 52 is filtered through the feed slurry 32 and drains into and through the first-stage basket perforations 63, from which it is directed into the housing 72. The solids 50 retained on the first-stage basket 62 and the remaining liquid 52 are then pushed onto the inside surface of the second-stage basket 66 by a non-reciprocating pusher plate 61 rotatably attached to the second-stage basket 66 by struts 70 as the first-stage basket 62 translates leftwards, as shown in FIG. 3.

The rotating second-stage basket 66 generates a centrifugal force, and the remaining liquid 52 of the feed slurry 32 is forced through the second-stage basket 66 by perforations 65 and directed into the housing 72. The outer edge 67 of the reciprocating first-stage basket 62, as it translates rightwards, as shown in FIG. 3, acts as another pusher plate to push the compacted and dellquoted solids 50 remaining on the inside surface of the second-stage basket 66 into the solids discharge chute 74 and out of the centrifuge 60.

Figure 3:
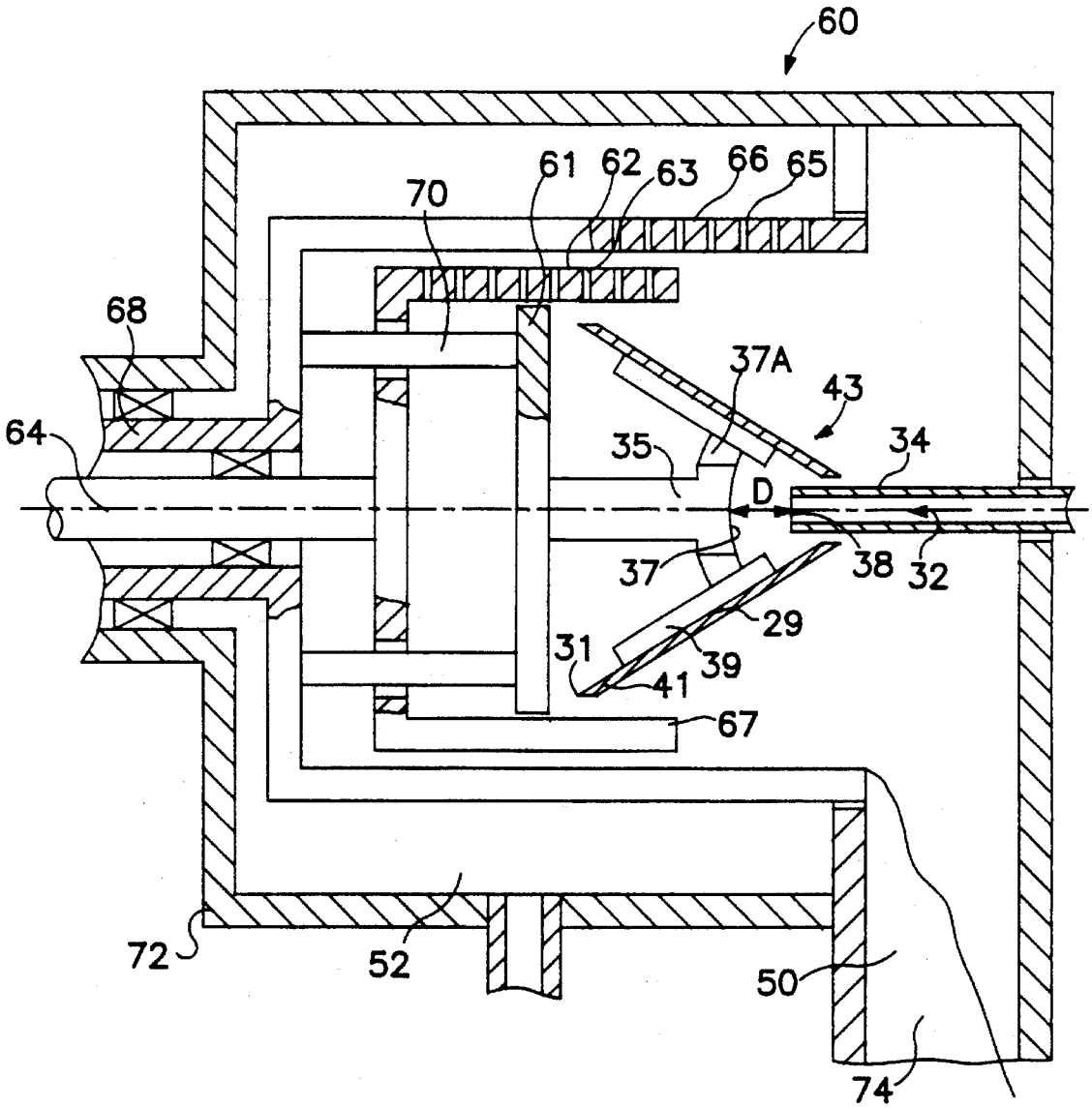
FIG. 3 is a schematic cross-sectional view of a basket centrifuge including one embodiment of a cone-shaped accelerator of the invention.

Experimental tests were conducted to determine the performance of the type of feed accelerator configuration shown in FIG. 3, in particular the efficacy of smoothener section 41 of cone-shaped accelerator 43. The tests were performed on a harvested sodium chloride slurry that was initially treated to concentrate it and remove much of the unwanted sulphate content. After this initial treatment, the sodium chloride was processed in a two-stage pusher centrifuge similar to the one shown in FIG. 3. The function of the centrifuge was to reduce the water content and to wash it for the purpose of reaching a low sulphate content in the sodium chloride crystals.

Originally, the pusher centrifuge had a conical feed accelerator without vanes, with a semi-included angle of 18 degrees, and a diameter at discharge of 10.2 inches. The modification consisted of installing sixteen longitudinal vanes which terminated 1 inch before the discharge diameter of the accelerating cone. Each accelerating vane was 1.25 inches tall and 3.25 inches long. In initial tests, the maximum capacity of the centrifuge was determined both before and after the modification described, with results as follows:

| | Maximum Capacity (tons per hour) |
|---|---|
| Before modification | 4.0 |
| After modification (installation of vanes and smoothener) | 7.1 |

Moreover, in these initial tests the moisture and sulphate contents of the product salt crystals were respectively comparable before and after the modification. Visual observation showed that, notwithstanding the concentration of the feed slurry at the driving faces of the vanes after the modification, the smoothener section was effective in restoring circumferential uniformity, as evidenced by the absence of longitudinally running ridges and valleys in the cake on both rotating baskets. This uniformity lent itself to uniform washing of the salt crystals downstream.

Further tests with a wide range of feed conditions confirmed the improvement resulting from the modification described, namely, the installation of sixteen accelerating vanes together with a smoothener. The following are average values obtained for 12 tests prior to the modification and for 6 tests subsequent to the modification:

| | Before Modification | After Modification |
|---|---|---|
| Capacity (tons per hour) | 2.07 | 5.20 |
| Percentage of moisture in product | 1.43% | 1.39% |
| Percentage of sulphates in product | 0.023% | 0.016% |

These results show that the modifications increased the capacity by a factor of 2.5. At the same time, the modifications resulted in reduced levels of both moisture and sulphate content in the product salt crystals, such reduced levels being advantageous.

The acceleration efficiency and separation efficiency of industrial centrifuges, such as the aforementioned devices, may be further increased by particular configurations of accelerator vane 39. As shown in FIG. 4A, the accelerator vanes 39 attached to the cone-shaped inside surface 29 of a cone-shaped or hub accelerator may be forwardly curved in the direction of rotation at a forward discharge angle 100 so as to form a plurality of curved feed channels 58. FIG. 4B shows the plurality of acceleration vanes 39 including a forward discharge angle 100 terminating at a location prior to the base 31 forming an unvaned portion or smoothener section 41. FIG. 4B also shows the flow pattern of feed slurry 32 as observed in the rotating frame of the accelerator. The forward curvature results in overspeeding of the feed slurry 32, that is, an acceleration efficiency at the cone accelerator base 31 greater than 100%. Such vanes 39 not only supply a greater circumferential speed to the feed slurry 32, but also compensate for the loss of acceleration efficiency as the feed slurry 32 passes from the radius at the cone base 31 to the larger radius at the first-stage basket 62.

Figure 5:
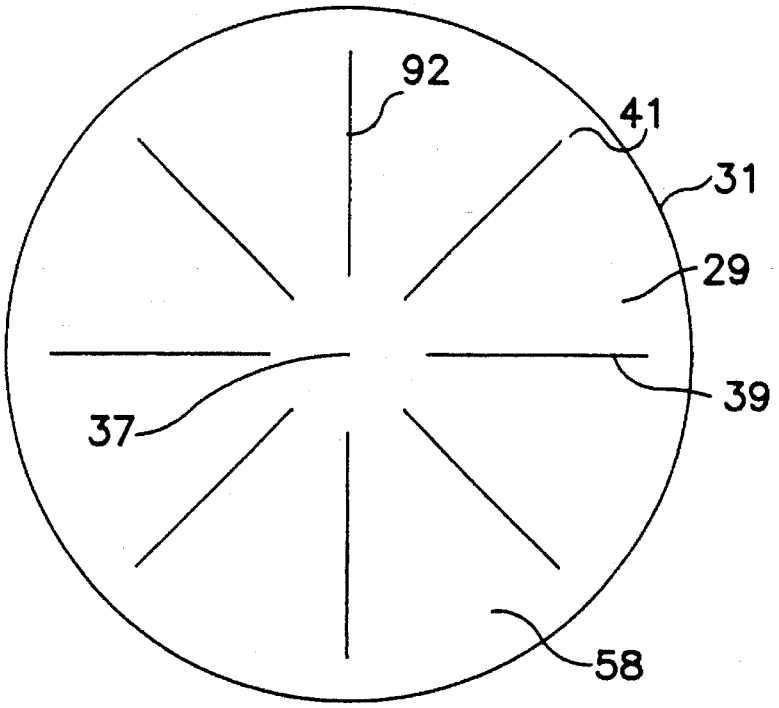
FIG. 5 is an axial view of a cone-shaped accelerator including straight vanes and a smoothener section.
Figure 6:
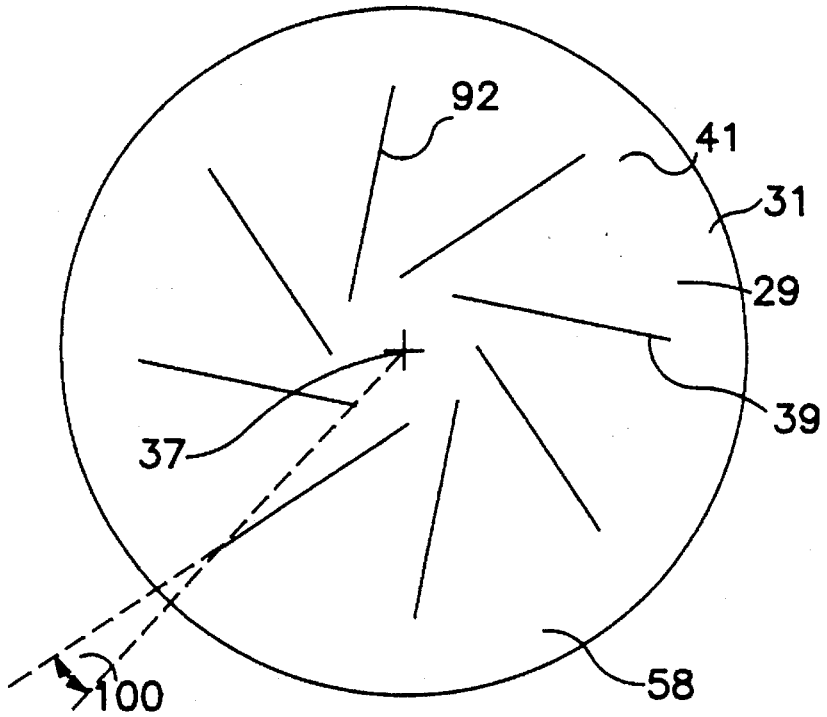
FIG. 6 is an axial view of a cone-shaped accelerator including forwardly angled vanes and a smoothener section.

FIG. 5 shows a smoothener section 41 and a plurality of accelerator vanes 39 extending radially from the distributor surface 37 forming a plurality of wedge-shaped feed channels 58. FIG. 6 shows a smoothener section 41 and a plurality of accelerator vanes 39 forwardly angled in the direction of rotation and forming a plurality of forwardly angled feed channels 58. It is understood that the accelerator vanes 39 may be attached perpendicularly to the inside surface 29 or at an angle, preferably at an angle that guides the flow toward the inside surface of the cone accelerator 43.

Figure 7:
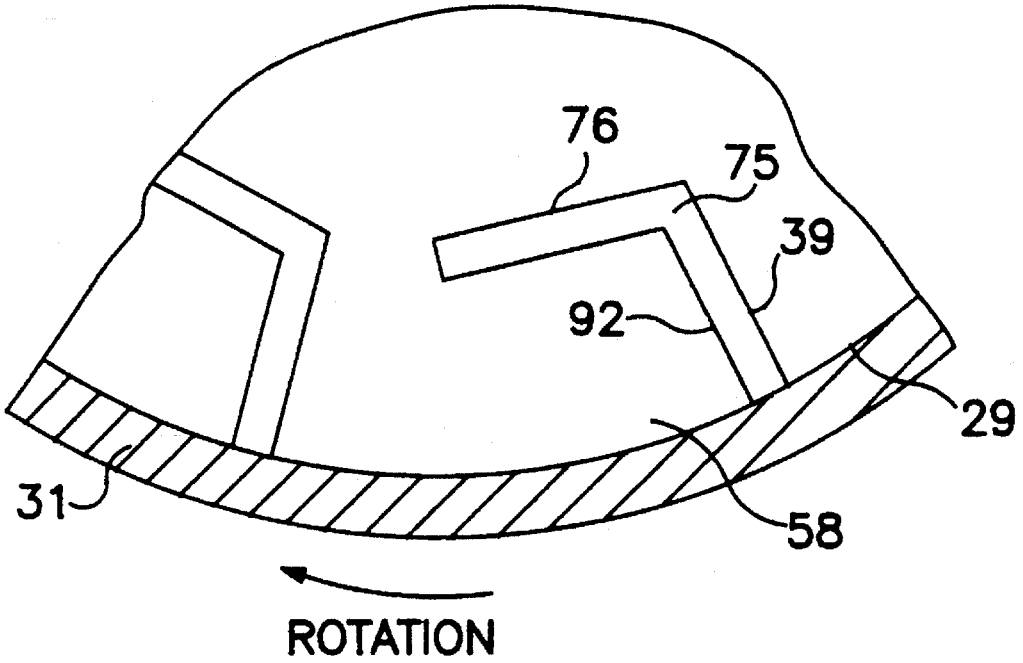
FIG. 7 is a partial end view of a cone-shaped accelerator having accelerator vanes and shrouds.
Figure 8:
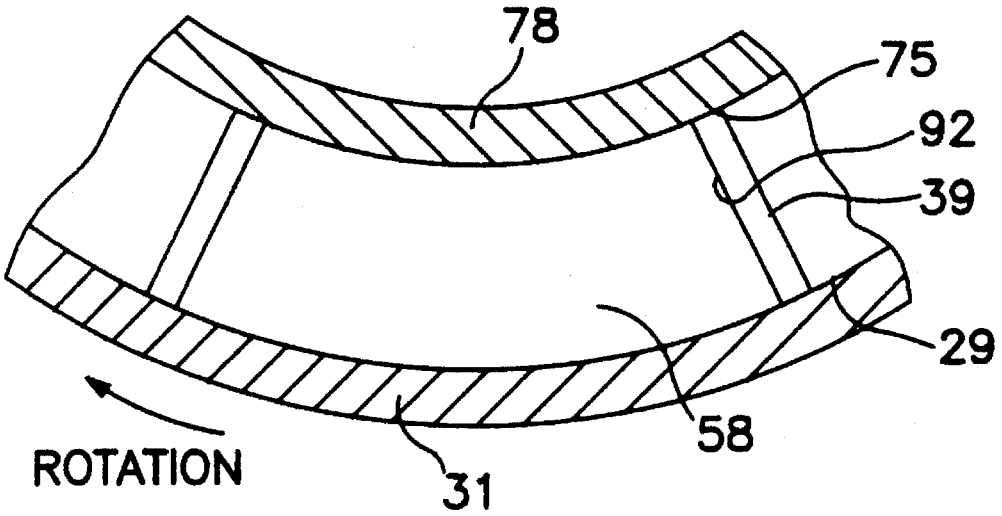
FIG. 8 is a partial end view of a cone-shaped accelerator including a secondary cone inside the cone-shaped accelerator and accelerator vanes disposed between the secondary cone and the cone-shaped accelerator.

Acceleration efficiency may be further improved by attaching a shroud 76 to the radially inward edge 75 of each accelerator vane 39 oriented in the direction of rotation, as shown in FIG. 7. Without such a shroud 76, the feed slurry 32 may spill over the forward face 92 of the vane 39, thus reducing acceleration efficiency. Alternatively, as shown in FIG. 8, a second cone 78 may be disposed adjacent to the first cone-shaped inside surface 29 and the accelerator vanes 39 attached between. Such an arrangement forms enclosed feed channels 58 which eliminate any possibility that the feed slurry 32 may spill over the forward face 92.

To reduce the cost of repeated maintenance to the centrifuge, each feed channel 58 of the cone-shaped or hub accelerator of the invention may include a wear resistant insert corresponding to the shape of the feed channel 58.

Acceleration efficiency of cone-shaped accelerators, such as the aforementioned accelerators, is greatly increased by improving the distribution of the feed slurry 32 from the feed pipe 34 to the accelerator vanes 39. Because the feed slurry 32 flows on the distributor surface 37 in a very thin film, usually on the order of a few millimeters or less, it is desirable to use a feed accelerator system including a distributor surface 37 having no sharp bends or junctions which would otherwise cause the flow of the feed slurry 32 to splash backwards, and thus escape acceleration by the vanes.

Figure 9A:
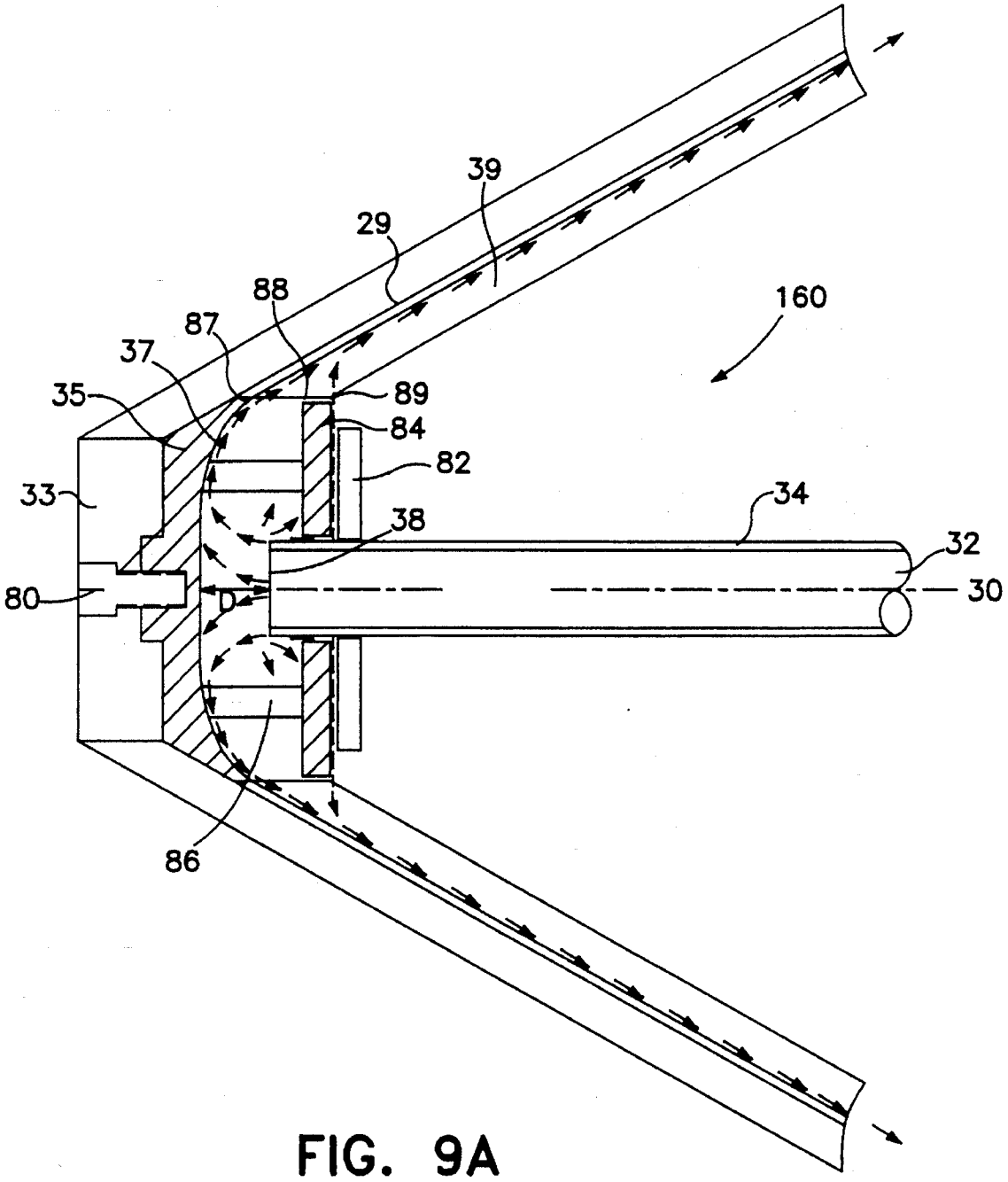
FIG. 9A is a cross-sectional view of one embodiment of the feed accelerator system of the invention.

As shown in FIG. 9A, the feed accelerator system 160 includes a feed distributor 35 removably attached to the accelerator small diameter section 33 by a distributor mounting apparatus, such as a bolt 80 extending from the small diameter section 33 and threaded into the distributor 35. The distributor 35 includes a non-convex distributor surface 37 having no sharp bends or junctions. In the preferred embodiment, the distributor surface 37 includes an approximate parabolic shape and joins the cone-shaped inside surface 29 so as to form a continuous accelerator inside surface having no sharp bends or junctions, and so as to join the inside surface of the cone accelerator 43 smoothly. Each accelerator vane 39 extending from the outer edge 87 of the distributor surface 37 includes a leading edge 88 generally parallel to the axis of rotation 30.

Attached to the distributor surface 37 by an attachment structure, shown as distributor vanes 86 or rods in FIG. 9A, is a ring-shaped rotating baffle 84. The distributor vanes 86 assist in accelerating the feed slurry 32 as the slurry 32 engages the distributor surface 37. The ring-shaped rotating baffle 84 has an inner radius so as to accept the feed pipe 34 entering the accelerator through the accelerator base 31. The outer radius of the rotating baffle 84 does not exceed the radius of the leading edges 88 of the accelerating vanes 39 and is positioned proximate to the rear end 89 of each leading edge 88. The rotating baffle 84 acts to direct any feed slurry 32 splashing back from the distributor surface 37 or flowing back along the outside of the feed pipe 34 into the feed channels 58 formed by the accelerator vanes 39. A ring-shaped stationary baffle 82 is attached to the feed pipe 34 proximate to the rotating baffle 84 so as to form a viscous drag pump which directs any leakage of feed slurry 32 between the outer surface of the feed pipe 34 and the rotating baffle 84 into the feed channels 58. It is understood that the rotating baffle 84 and the stationary baffle 82 may be used separately.

An experimental rig was used to test the performance of a feed accelerator system 160 similar to that shown in FIG. 9A. The cone accelerator 28 of the feed accelerator system 160 included a semi-included angle of 30 degrees and a radius at the accelerator base 31 of 10.0 inches. Sixteen accelerator vanes 39 were installed on inside surface 29, spaced uniformly, and oriented in the longitudinal direction, as shown in FIG. 5. Each accelerator vane 39 had a shroud 76 which extended to the adjacent vane 39. The feed accelerator system 160 included a distributor 35 with an approximately parabolic distributor surface 37, a ring-shaped rotating baffle 84, and a ring-shaped stationary baffle 82, all substantially positioned as depicted in FIG. 9A. The feed pipe 34 had a discharge opening 38 with an inside diameter of 1.5 inches, and was positioned at a stand-off distance D of 1.5 inches from non-convex, parabolic distributor surface 37.

The conveyor hub 26 was rotated at a speed of approximately 2000 revolutions per minute. A preliminary test, with the rotating baffle 84 and the stationary baffle 82 both absent, and with a flow rate of feed slurry 82 (modelled by water) of 240 gallons per minute, indicated an acceleration efficiency of 62 percent. Subsequently, with the baffles 84 and 82 both in place, and at the same flow rate of 240 gallons per minute, the acceleration efficiency was determined to be 97 percent. This comparative test demonstrates the importance of a rotating baffle 84 in assuring good distribution of feed slurry 32 into the channels 58 formed by accelerator vanes 39.

Figure 9B:
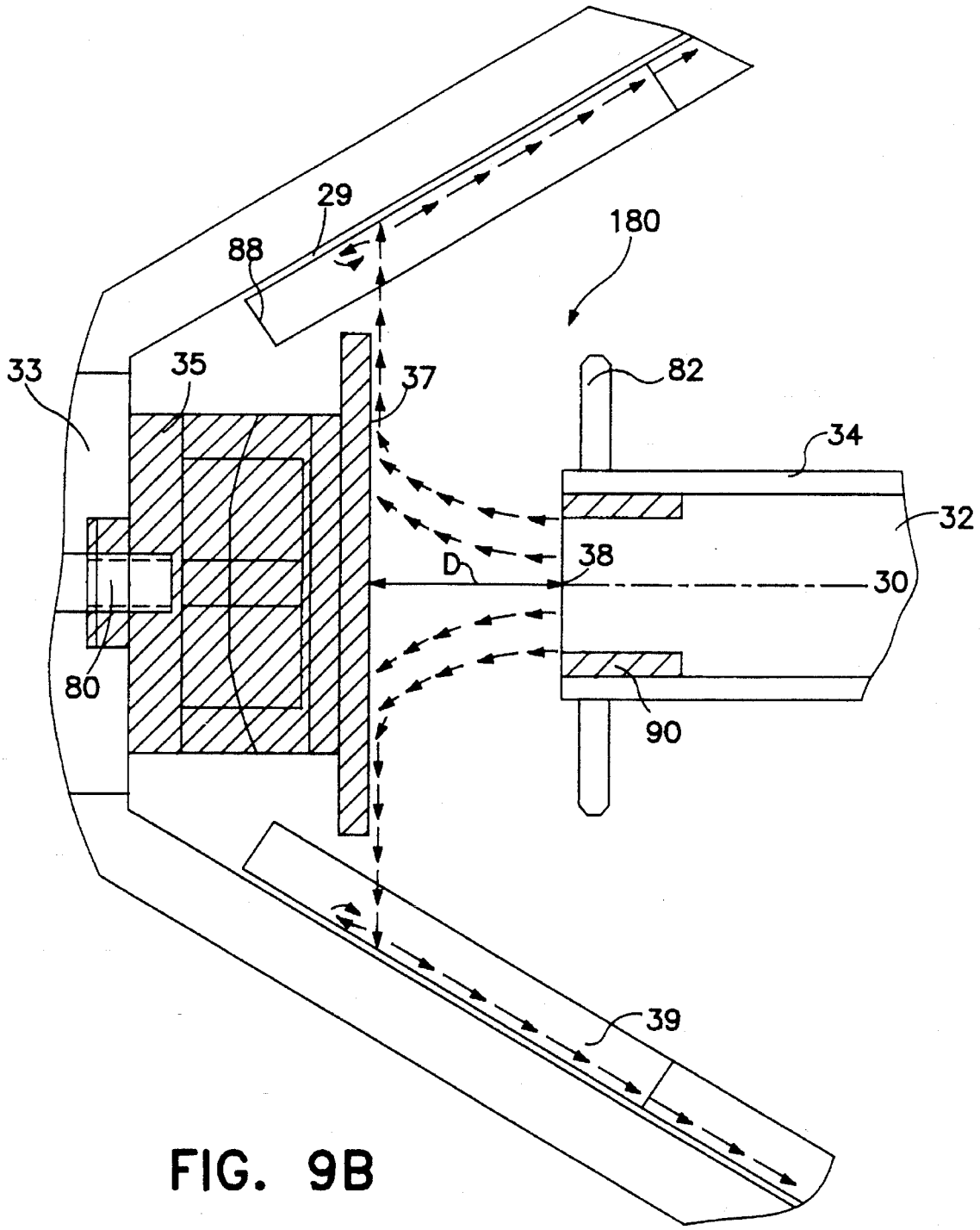
FIG. 9B is a cross-sectional view of another embodiment of the feed accelerator system of the invention.

Another feed accelerator system 180 is shown in FIG. 9B. Attached to the small diameter section 33 by an attachment means, such as a bolt 80, is a distributor 35 having a flat distributor surface 37 extending forward of the leading edge 88 of each accelerator vane 39. The portion of the accelerator vanes 39 that extend behind the flat distributor surface 37 redirects toward the cone base 31 any feed slurry 32 that may initially flow toward the small diameter section 33 after leaving the flat distributor surface 37. The feed pipe 34 includes a flow restrictor 90 for increasing the velocity of the feed slurry 32 exiting the feed pipe 34 at the discharge opening 38, thereby reducing the gravitational droop of the feed slurry 32 so as to improve the distribution of the feed slurry 32.

An experimental test was performed on a municipal sludge dewatering decanter centrifuge, similar to that of FIG. 1B, but with a feed accelerator system 180 similar to that shown in FIG. 9B. The objective was to evaluate the performance of the feed accelerator system 180, particularly the use of distributor 35 with flat surface 37 situated forward of leading edges 88 of accelerator vanes 39, as well as the use of stationary baffle 82, both in combination with accelerator vanes 39. Also present was a flow restrictor 90 for increasing the velocity of feed slurry 32 at the discharge opening 38 for the purpose of reducing gravitational droop.

The cone had a semi-included angle of 30 degrees, and a diameter at its discharge end of 13.83 inches. The feed pipe inside diameter was 1.5 inches and the inside diameter of constriction 90 was 1.0 inches. The stand-off distance D was 1.5 inches. Eight longitudinal accelerator vanes were present in the accelerator cone, each ½-inch high.

A preliminary test using water as the feed was carried out at a rotative speed of 1988 revolutions per minute and a flow rate of 116 gallons per minute. The acceleration efficiency was measured with distributor surface 37 situated both forward of leading edges 88 (as depicted in FIG. 9B) and also rearward of leading edges 88, with results as follows.

| Position of Distributor Surface 37 | Acceleration Efficiency |
|---|---|
| Forward of leading edges 88 by 1/16 inch | 82% |
| Rearward of leading edges 88 by 17/16 inches | 39% |

These results demonstrated the efficacy of the feed accelerator system 180 shown in FIG. 9B.

In experimental tests of the centrifuge described in the preceding paragraph, while treating municipal sludge with operation at 3200 revolutions per minute, the original performance of the centrifuge with a conventional feed accelerator was compared with the performance achieved when the feed accelerator system 180 of FIG. 9B was installed. The original performance was greatly improved upon in two respects. First, originally there was a substantial leakage of the feed slurry past the annular gap between the feed pipe 34 and the inner surface of conveyor hub 26; this leakage was completely eliminated when distributor surface was positioned as shown in FIG. 9B. Second, the performance in treating municipal sludge was improved substantially, as shown by the following table:

| | Before Modification | After Modification |
|---|---|---|
| Capacity for handling municipal feed (gallons per minute) | 45 | 60 |
| Polymer pump setting | 75% | 85% |
| Percentage of solids in sludge cake | 15–16% | 15–16% |

It was concluded that, by using the feed accelerator system 180 of FIG. 9B, 30% to 40% more gallons of sludge per day can be processed, and that such separation requires only 13% more polymer consumption. These two figures in combination are equivalent to a 15% reduction in the amount of polymer per gallon of sludge. In addition, the solids recovery was increased from 86% to 96%, thus demonstrating that the feed accelerator system 180 of FIG. 9B produces a clearer effluent.

Figure 9C:
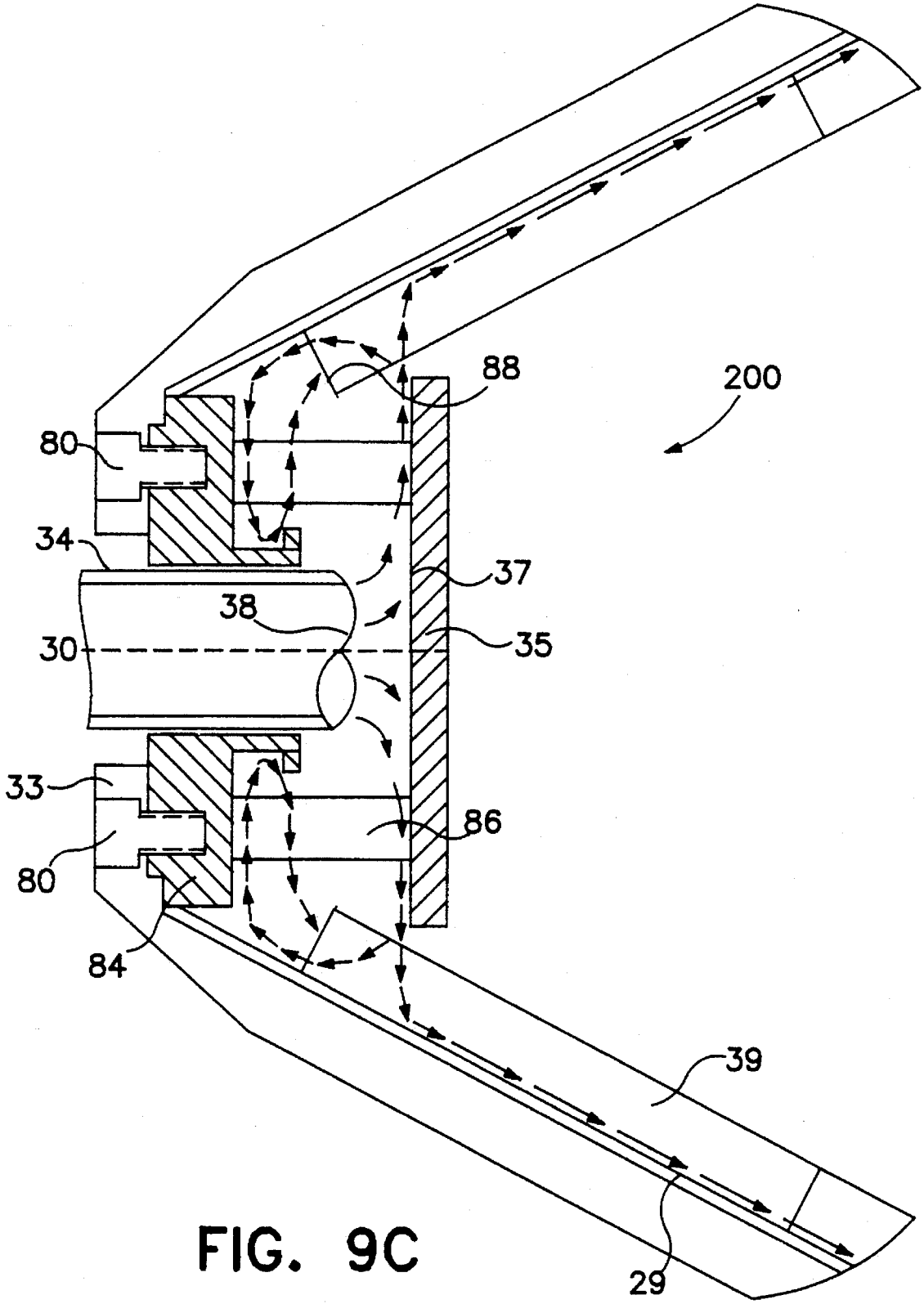
FIG. 9C is a cross-sectional view of another embodiment of the feed accelerator system the invention.

FIG. 9C depicts another feed accelerator system of the invention. In this embodiment, the feed pipe 34 enters the cone-shaped accelerator of the feed accelerator system 200 through the small diameter section 33. A rotating baffle 84 having an inner radius for accepting the feed pipe 34 is attached to the small diameter section 33 by an attachment apparatus, such as bolts 80. A distributor 35 having a flat surface 37 is attached to the rotating baffle 84 by distributor vanes 86 or rods. The leading edge 88 of each accelerator vane 39 is positioned between the rotating baffle 84 and the distributor surface 37. The feed slurry 32 engaging the flat distributor surface 37 is generally directed into the feed channels 58 formed by the accelerator vanes 39. The feed slurry 32 flowing toward the small diameter section 33 after leaving the distributor surface 37 is directed back into the feed channels 58 by the rotating baffle 84.

It is understood that any of the aforementioned cone-shaped or hub accelerator elements may include a wear resistant material so as to reduce the cost of repeated maintenance to the centrifuge.

What is claimed is:

1. A feed accelerator system for use in a centrifuge, the system comprising a cone-shaped accelerator having an included angle of less than one hundred and eighty degrees, a feed pipe disposed within the centrifuge for delivery of a feed slurry to the accelerator, and a plurality of accelerator vanes disposed on a portion of an inside surface of the cone-shaped accelerator so that an unvaned conical extension of the inside surface of the cone-shaped accelerator forms a cone smoothener adapted to smooth out the flow of the feed slurry to produce circumferential flow uniformity.

* * * * *